United States Patent [19]

McCullers

[11] 4,425,052

[45] Jan. 10, 1984

[54] RETAINING WALL

[76] Inventor: Jeffrey L. McCullers, 4603 Riverhills Dr., Tampa, Fla. 33617

[21] Appl. No.: 164,798

[22] Filed: Jun. 30, 1980

[51] Int. Cl.[3] ..... E02B 3/04; E02D 29/02

[52] U.S. Cl. ..... 405/32; 405/284

[58] Field of Search ..... 405/15, 16, 19, 30, 405/32, 34, 35, 284, 285, 258, 28

[56] References Cited

U.S. PATENT DOCUMENTS

| | | | |
|---|---|---|---|
| 982,621 | 1/1911 | Maxey et al. . | |
| 1,371,119 | 3/1921 | Scott | 405/35 |
| 1,575,362 | 3/1926 | Haupt | 405/34 |
| 1,888,364 | 11/1932 | Van Orman . | |
| 1,907,135 | 5/1933 | Wemlinger et al. | 405/285 |
| 1,969,123 | 8/1934 | Doble | 405/28 |
| 2,341,515 | 2/1944 | Rehfeld . | |
| 3,011,316 | 12/1961 | Wilson | 405/28 |
| 3,381,483 | 5/1968 | Huthsing | 405/285 X |
| 3,426,536 | 2/1969 | Danz . | |
| 3,517,514 | 6/1970 | Visser | 405/19 |
| 4,080,793 | 3/1978 | Pulsifer | 405/30 |
| 4,117,686 | 10/1978 | Hilfiker . | |
| 4,279,535 | 7/1981 | Gagliardi | 405/15 |
| 4,341,491 | 7/1982 | Neumann | 405/258 |

FOREIGN PATENT DOCUMENTS

| | | | |
|---|---|---|---|
| 6604057 | 9/1967 | Netherlands | 405/285 |

*Primary Examiner*—David H. Corbin

*Attorney, Agent, or Firm*—Frijouf, Rust & Pyle

[57] ABSTRACT

A retaining wall disposed along the embankment of a body of water to protect the embankment from erosion due to movement of the body of water. The retaining wall comprises a plurality of pilings disposed adjacent to one another along the contour of the embankment. A porous material is disposed adjacent to the landward side of the pilings for covering the natural orifices which exist between each pair of pilings. The porous material precludes sand and soil constituting the embankment from being washed out through the natural orifices. The deck of the retaining wall comprises a plurality of deck members which are connected in a spaced apart relationship to the upper portions of the pilings and extend substantially perpendicular therefrom to the embankment. The foregoing abstract is merely a resume of one general application, is not a complete discussion of all principles of operation or applications and is not to be construed as a limitation on the scope of the claimed subject matter.

4 Claims, 6 Drawing Figures

FIG. 3
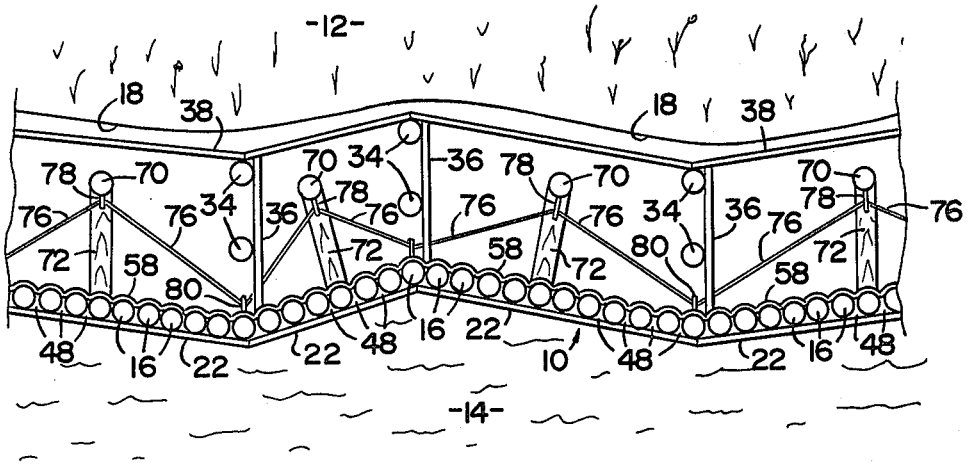
FIG. 4
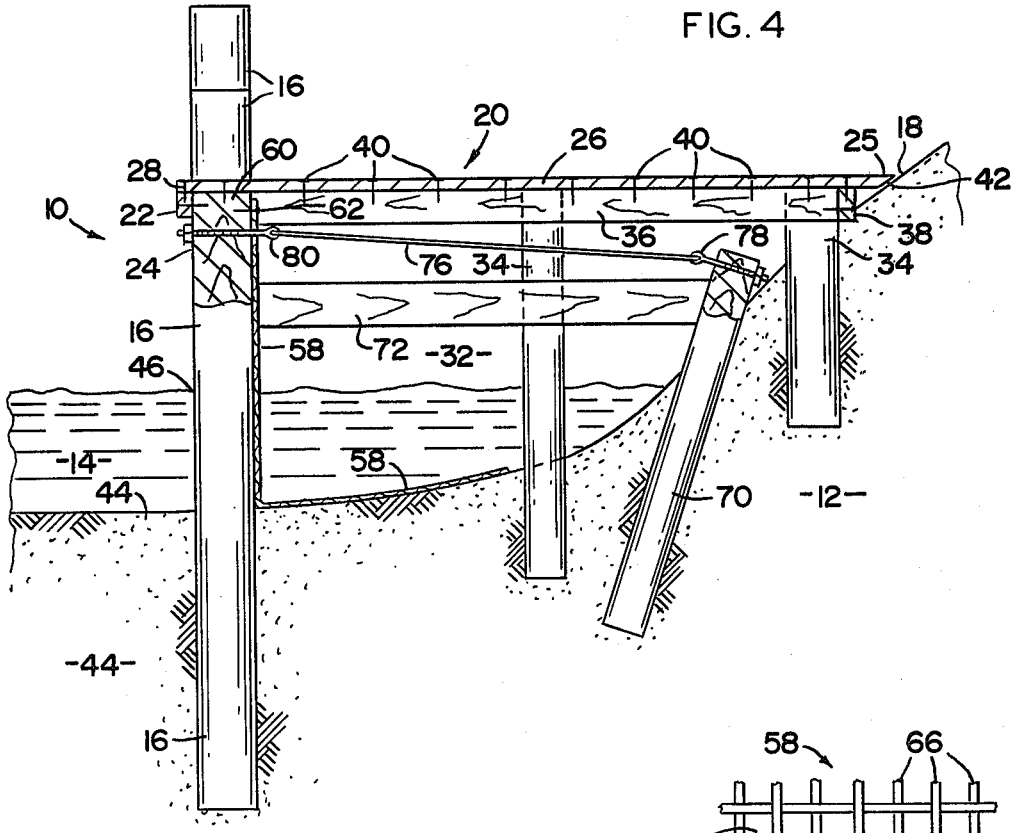
FIG. 5
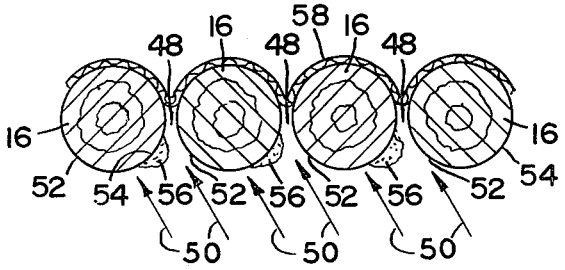
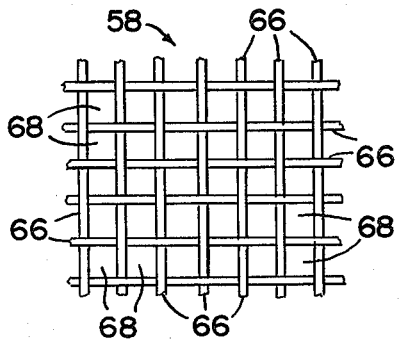
FIG. 6

RETAINING WALL

BACKGROUND OF THE INVENTION

1. Field of the Invention

This invention relates to retaining walls disposed along the embankment of a body of water for protecting the embankment from erosion due to the movement of the body of water.

2. Description of the Prior Art

Presently there exists many types of retaining walls, commonly referred to as seawalls, which are disposed along an embankment of a body of water to protect the embankment from erosion due to wave action present in the body of water. These prior art seawalls basically comprise a plurality of metal or concrete slabs which are embedded into the bed of the body of water along the embankment and secured by means of a cable which is anchored into the embankment. The landward side of the slab seawall is then usually filled with soil.

A major disadvantage to the prior art slab seawalls is their solid construction which precludes water from passing therethrough. An enormous amount of back pressure gradually builds up on the landward side of the slab seawall. The increase of pressure will either collapse the seawall or, in attempting to escape, the water will bleed under the seawall thereby creating a washout at the base of the seawall. The continued washing at the base will eventually undermine the seawall, causing it to collapse. Washout of the seawall can also occur due to runoff water from the embankment flowing over the seawall and washing out the seaward base of the seawall.

The prior art slab seawalls are also particularly susceptible to being damaged by wave action of the body of water. Specifically, the seawall, being a very rigid and inflexible structure, is struck with the full force of each wave rather than absorbing or cushioning the wave. Severe erosion and damage to the seawall eventually occurs.

In many states, particularly Florida, a large number of homeowners have installed the prior art slab seawalls on their waterfront property. The proliferation of the building of seawalls has destroyed the habitat of many aquatic animals and microorganisms thereby disrupting the balance of nature. As a result, the installation of slab seawalls is now unlawful and therefore prohibited in Florida.

Probably the most successful attempt to overcome the disadvantages of the prior art slab seawalls has been U.S. Pat. No. 4,117,686, issued to Hilfiker which teaches the use of generally rectangular trays of steel wire fabric sheets which are stacked on top of one another to form a retaining wall. The interior of the retaining wall is then filled with rocks or stones. A major problem with this type of seawall is its use of metal fabric sheets which are foreign to the natural surroundings thereby upsetting the balance of nature.

Therefore it is an object of this invention to provide an apparatus which overcomes the aforementioned inadequacies of the prior art devices and provides an improvement which is a significant contribution to the advancement of the retaining wall art.

An object of this invention is to provide a retaining wall comprising a plurality of pilings which are disposed adjacent to one another along the embankment of a body of water.

Another object of this invention is to provide a retaining wall having a deck extending from the plurality of pilings to the embankment.

Another object of this invention is to provide a retaining wall having a deck which comprises a plurality of horizontal decking members which are spaced apart from one another to allow runoff water from the embankment to enter the interior of the retaining wall.

Another object of this invention is to provide a retaining wall having a plurality of pilings which are substantially cylindrical shaped poles which create natural orifices between each pair of pilings when disposed adjacent to one another.

Another object of this invention is to provide a retaining wall including a porous material disposed adjacent to the landward side of the retaining wall for retaining the fine particles of sand and soil constituting the embankment from being washed out through the natural orifices formed between each pair of pilings.

Another object of this invention is to provide a retaining wall having a porous material disposed adjacent to the landward side of the plurality of pilings which overlaps at least a portion of the bottom of the interior of the retaining wall.

Another object of the invention is to provide a retaining wall including support means which comprises a deadman anchor disposed in the embankment, a horizontal deadman member disposed between the deadman anchor and one of the pilings, and a flexible member interconnecting the deadman anchor with the series of pilings.

The foregoing has outlined some of the more pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description describing the preferred embodiment in addition to the scope of the invention defined by the claims taken in conjunction with the accompanying drawings.

SUMMARY OF THE INVENTION

The invention is defined by the appended claims with a specific embodiment shown in the attached drawings. For the purposes of summarizing the invention, the invention comprises a retaining wall disposed along the contour of the embankment of a body of water to protect the embankment from erosion due to movement of the body of water. The retaining wall comprises a plurality of substantially cylindrical pilings which are disposed in the bed of the body of water. The substantially cylindrical shape of the pilings create natural orifices between each pair of pilings as the pilings are embedded into the bed of the body of water. The natural orifices enable water to pass to and from the plurality of pilings thereby eliminating the back pressure commonly found in most prior art slab seawalls. The natural orifices also have the effect of cushioning the wave action which may strike the plurality of pilings.

A porous material is disposed adjacent to the landward side of the pilings for covering the natural orifices which exist between each pair of pilings. The porous material disposed adjacent to the pilings precludes sand and soil constituting the embankment from being washed out through the natural orifices. The porous material also extends below the pilings and overlaps at least a portion of the bottom of the interior of the retaining wall. Such overlapping enables the porous material to settle downwardly as the bottom settles.

A deck is provided which extends from the plurality of pilings to the embankment. Specifically, the deck comprises a plurality of horizontal decking members which are preferably spaced apart from one another and extend from the plurality of pilings to the embankment. Such spacing allows runoff water from the embankment to enter the interior of the retaining wall rather than flowing over the retaining wall and causing a washout at the base thereof.

It is noted that the retaining wall may require additional support when used along a particularly rough body of water. The support means comprises a deadman anchor angularly disposed within the embankment. A horizontal deadman member is then disposed between the deadman anchor and one of the pilings. A flexible member such as a noncorrosive cable interconnects the deadman anchor with the series of pilings. A shackle may be provided for imparting tension into the flexible member to rigidly secure the horizontal deadman member between the deadman anchor and the pilings.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which:

FIG. 3 is a plan view of FIG. 1 with the decking removed showing the means for securing the retaining wall relative to the embankment;

FIG. 4 is a cross-sectional view of FIG. 2 along lines 4—4 showing the means for anchoring the retaining wall relative to the embankment and showing the means for supporting the decking;

FIG. 5 is a cross-sectional view of FIG. 3 along lines 5—5 showing the porous material disposed along the landward side of the retaining wall;

FIG. 6 is an enlarged partial view of the porous material showing the pores disposed therein.

Similar reference characters refer to similar parts thorughout the several views of the drawings.

DETAILED DESCRIPTION OF THE PREFERRED EMBODIMENT

Figure 1:
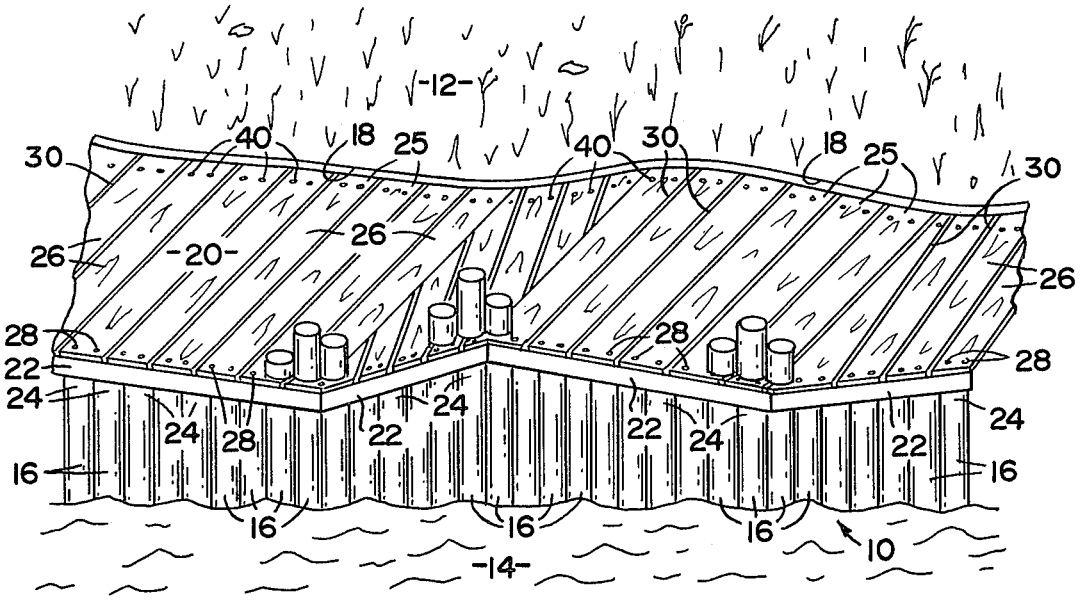
FIG. 1 is a perspective view of the retaining wall disposed along the embankment of a body of water.

FIG. 1 is a perspective view of the invention showing a retaining wall 10 disposed along the embankment 12 of a body of water 14. The retaining wall 10 protects the embankment 12 from erosion due to the movement of the body of water 14. The retaining wall 10 comprises a plurality of pilings 16 disposed adjacent to one another which follow the contour 18 of the embankment 12. The displacement of the plurality of pilings 16 away from the contour 18 of the embankment 12 is not only esthetically pleasing but also creates a bulkhead in which an appropriate amount of fill may be added to rebuild the embankment 12 to its original displacement into the body of water 14.

Figure 2:
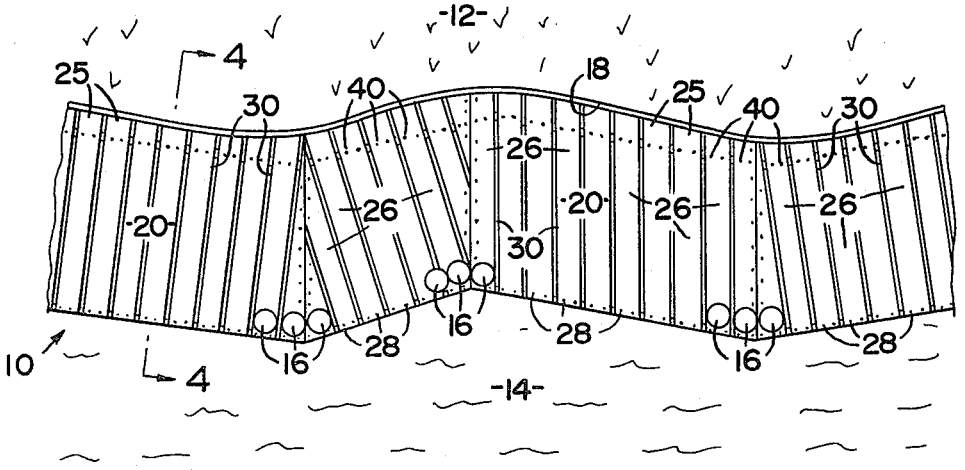
FIG. 2 is a plan view of FIG. 1 showing the configuration of the decking.

As shown in FIG. 2, a deck 20 is secured to the retaining wall 10 and extends therefrom to the contour 18 of the embankment 12. More specifically, deck 20 comprises a horizontal member 22 disposed on the seaward side of the upper portion 24 of the series of pilings 16. A plurality of deck members 26 are connected to the horizontal member 22 by means of noncorrosive nails 28 or the like. The deck members 26 extend substantially perpendicular from the horizontal member 22 to the embankment 12. The deck members 26 are preferably spaced from $\frac{5}{8}$ to $\frac{1}{2}$ inch apart from one another. Such spacing 30 allows runoff water from embankment 12 to enter the interior 32 of the retaining wall 10. The runoff water is therefore precluded from flowing over the deck 20 and creating a washout at the base of the retaining wall 10.

As shown in FIGS. 3 and 4, the deck members 26 are supported as the deck members 26 extend from the retaining wall 10 to the embankment 12. Specifically, such supporting means comprises a plurality of pilings 34 embedded into the embankment 12 and extend in a colinear manner from the retaining wall 10 to the embankment 12. A horizontal connecting member 36 interconnects each series of pilings 34 to one of the pilings 16 constituting the retaining wall 10. A plurality of horizontal stringer members 38 then interconnect the proximal end of each series of pilings 34 with one another. The deck members 26 are connected to the horizontal connecting members 36 and the horizontal stringer members 38 by means of noncorrosive nails 40 or the like. The proximal end 25 of each deck member 26 may be cut at an angle 42 to more accurately conform to the slope of the embankment 12.

As noted earlier, FIG. 3 is a plan view of FIG. 1 having the deck 20 removed for showing the particular shape of pilings 16. Specifically, pilings 16 are roughly cylindrically shaped poles which have been water treated to resist deterioration in salt or brackish water. As shown in FIG. 4, pilings 16 are disposed within the bed 44 of the body of water 14 to a depth at least equal to the length of the piling 16 disposed above the mean high water line 46 of the body of water 14. Experience has shown that such a particular disposition substantially precludes soil erosion and undermining of the pilings 12 due to the movement of the body of water 14.

As illustrated in FIG. 5, the substantially cylindrical shape of the pilings 16 has the effect of creating natural orifices 48 between each pair of pilings 16 as the pilings 16 are disposed adjacent to one another. The natural orifices 48 enable water to pass to and from retaining wall 10. The back pressure commonly associated with prior art retaining walls is therefore eliminated due to the fact that no water builds up within the interior 32 of the retaining wall 10. The natural orifices 48 have the further effect of enabling the retaining wall 10 to absorb the movement of the body of water 14. Specifically, wave action striking the retaining wall 10 is cushioned due to the dispersion of some of the energy of the wave action through the natural orifices 48. Moreover, the substantially cylindrical shape of the pilings 16 causes a dissipation of the energy of the wave action as the wave strikes the retaining wall 10 as shown by arrows 50. The dissipation of the wave energy against the retaining wall 10 is due to the fact that more energy of the wave action is dissipated at a high point 52 rather than the low point 54 of the pilings 16. Sand 56 is therefore deposited at the low point 54. The substantially cylindrical shape of pilings 16 is also advantageous in that it creates a natural habitat for aquatic animals and organisms. The balance of nature is therefore unaffected through the use of this invention.

As shown in FIGS. 3 and 4, a sheet of porous material 58 is disposed on the landward side of the series of pilings 16. More specifically, the sheet of porous material 58 is loosely suspended from the upper portion 60 of each of the pilings 16 by means of noncorrosive nails 62 or the like. The sheet of material 58 drapes loosely from nails 62 along the landward side of pilings 16. The sheet of material 58 then extends along the bed 44 of the body of water 14. Preferably, sheet of material 58 is lapped over the bed 44 to a distance of about 3 feet which enables the sheet of material 58 to settle downwardly to preclude undermining of the retaining wall 10.

As illustrated in FIG. 5, the porous material 58, being loosely draped from the upper portion 60 of pilings 16, easily conforms to the substantially cylindrical shape of each of the pilings 16. The porous material 58 therefore snugly fits adjacent to the pilings 16. As shown in FIG. 6, the porous material 58 comprises a fabric material weaved from a plurality of fibers 66 thereby creating a plurality of pores 68 therein. In the preferred embodiment, the fibers 66 are chemically resistant polypropylene fibers commonly found in the art which are unaffected by prolonged exposure to either fresh or salt water and to either alkaline or acid soil conditions. For example, the porous material 58 may comprise a polypropylene fabric sold under the trademark FILTERWEAVE and manufactured by Bradley Materials Co., Inc. of Valparaiso, Fla. FILTERWEAVE has proved to be desirable, since the area of the pores 68 in the fabric remains constant even under the weight of the embankment.

It is noted that the fibers 66 may be loosely weaved together thereby creating fairly large pores 68 therein. Conversely, fibers 66 may be tightly weaved together thereby creating relatively smaller pores 68. Accordingly, depending upon the type of soil constituting the embankment 12 and the bed 44 of the body of water 14, various sizes of the pores 68 may be desirable. Specifically, when utilizing the retaining wall 10 along a river bank, experience has shown that the area of the pores 68 should not be less than four per cent and not more than ten per cent of the total area of the porous material 58.

The position of the porous material 58 along the landward side of the series of pilings 16 prevents fine particles of sand and soil constituting the embankment 12 from washing out between the natural orifices 48. The porous material 58 is also especially desirable in that it prevents any foreign material which has been washed off of the embankment 12 into the interior 32 of the retaining wall 10 from polluting or otherwise contaminating the body of water.

Returning now to FIGS. 3 and 4, it is noted that the series of pilings 16 may require support when subjected to large wave movements on the body of water 14. In this case, a deadman anchor 70 is disposed within the embankment 12 in an angular relationship with respect to the pilings 16. A horizontal deadman member 72 is disposed between the upper portion 74 of the deadman anchor 70 and one of the pilings 16. A flexible member 76 such as a noncorrosive cable or the like is threaded through an eyebolt 78 disposed within the upper portion 74 of the deadman anchor 70. The flexible member 76 is then further threaded through another eyebolt 80 connected to one of the pilings 16. This threading procedure is continued until all of the deadman anchors 70 are interconnected with one another and with the pilings 16, as shown in FIG. 3. An appropriate amount of tension is imparted to the flexible member 76 by means of a shackle (not shown) or the like thereby rigidly securing the deadman member 72 between the deadman anchor 70 and the piling 16.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

I claim:

1. A retaining wall disposed along an embankment of a body of water for impeding the erosion of the embankment during movement of the body of water, comprising in combination:

a plurality of wood pilings disposed adjacent to one another along the embankment and embedded into the bed of the body of water in substantially adjacent upright relationship a distance from the natural high water shore line;

each of said pilings being of substantially cylindrical shape to create natural orifices between each pair of pilings to enable water to pass to and from the landward side of said plurality of pilings and to cushion any waves which may strike the plurality of pilings;

a sheet of porous material disposed along the landward side of said pilings, means suspending said sheet from the upper portion of said pilings, said sheet conforming to the substantially cylindrical shape of each of the pilings and being disposed to cover said natural orifices, said sheet further extending along the bed of the body of water in a landward direction from said pilings to prevent undermining of said pilings;

said sheet including a plurality of pores, said pores permitting water flow in both directions through the sheet but preventing fine particles of sand and soil from passing through said orifices.

2. The retaining wall as set forth in claim 1, wherein said sheet of porous material being man-made fabric of water rot resistant character.

3. The retaining wall as set forth in claim 1, wherein said sheet of porous material is a fabric weaved from polypropylene fibers to create said pores disposed therein.

4. The retaining wall as set forth in claim 1, wherein the area of said pores is not less than four percent and not more than ten percent of the total area of said sheet material.

* * * * *